US005982099A

United States Patent [19]

Barnes et al.

[11] Patent Number: 5,982,099

[45] **Date of Patent: *Nov. 9, 1999**

[54] METHOD OF AND APPARATUS FOR IGNITING A PLASMA IN AN R.F. PLASMA PROCESSOR

[75] Inventors: Michael S. Barnes, San Francisco; Brett Richardson, San Ramon; Tuan Ngo, Milpitas; John Patrick Holland, Santa Clara, all of Calif.

[73] Assignee: Lam Research Corporation, Fremont, Calif.

[ * ] Notice: This patent is subject to a terminal disclaimer.

[21] Appl. No.: 08/624,124

[22] Filed: Mar. 29, 1996

[51] Int. Cl.[6] ..... H05H 1/24

[52] U.S. Cl. ..... 315/111.21; 333/17.3; 333/32; 333/99 PL

[58] Field of Search ..... 333/17.3, 32, 99 PL; 315/111.21

[56] References Cited

U.S. PATENT DOCUMENTS

| | | | |
|---|---|---|---|
| 3,436,333 | 4/1969 | Beaudry | 333/32 X |
| 3,995,237 | 11/1976 | Brunner | 333/17.3 |
| 4,356,458 | 10/1982 | Armitage | 333/17.3 |
| 4,373,581 | 2/1983 | Toellner | 333/17.3 X |
| 4,375,051 | 2/1983 | Theall | 333/17.3 |
| 4,485,360 | 11/1984 | Seward | 333/17.3 |
| 4,679,007 | 7/1987 | Reese et al. | 333/17.3 |
| 5,187,454 | 2/1993 | Collins | 333/17.3 |
| 5,288,971 | 2/1994 | Knipp | 315/111.21 X |
| 5,383,019 | 1/1995 | Farrell et al. | 356/316 |
| 5,629,653 | 5/1997 | Stimson | 333/17.3 |
| 5,689,215 | 11/1997 | Richardson et al. | 333/17.3 |
| 5,793,162 | 6/1998 | Barnes et al. | 315/111.21 |

FOREIGN PATENT DOCUMENTS

| | | |
|---|---|---|
| 390719 A1 | 2/1989 | Germany . |
| 61139111 | 12/1984 | Japan . |

*Primary Examiner*—Benny T. Lee

*Attorney, Agent, or Firm*—Lowe Hauptman Gopstein Gilman Berner

[57] ABSTRACT

A gas in a vacuum plasma processing chamber is ignited to a plasma by subjecting the gas to an r.f. field derived from an r.f. source having a frequency and power level sufficient to ignite the gas into the plasma and to maintain the plasma. The r.f. field is supplied to the gas by a reactive impedance element connected via a matching network to the r.f. source. The matching network includes first and second variable reactances that control loading of the source and tuning a load, including the reactive impedance element and the plasma, to the source. The value of only one of the reactances is varied until a local maximum of a function of power coupled between the source and the load is reached. The value of only the other reactance is varied until a local maximum of the function is reached. The two varying steps are then repeated as necessary.

37 Claims, 2 Drawing Sheets

METHOD OF AND APPARATUS FOR IGNITING A PLASMA IN AN R.F. PLASMA PROCESSOR

FIELD OF THE INVENTION

The present invention relates generally to a vacuum plasma processor method and apparatus and more particularly to such a method and apparatus wherein ignition of a gas into a plasma is controlled by sequentially varying the values of first and second reactances of a matching network connected between an r.f. source and a load including the plasma and a reactive impedance element that supplies an r.f. field to the gas to ignite the gas into a plasma and maintain the plasma.

BACKGROUND ART

Vacuum plasma processors are used to deposit materials on and etch materials from workpieces that are typically semiconductor, dielectric and metal substrates. A gas is introduced into a vacuum plasma processing chamber where the workpiece is located. The gas is ignited into a plasma in response to an r.f. electric or electromagnetic field. The r.f. field is provided by a reactive impedance element, usually either an electrode array or a coil which couples both magnetic and electrostatic r.f. fields to the gas. The reactive impedance element is connected to an r.f. source having an r.f. frequency and sufficient power such that the gas is ignited into the plasma. Connections between the source and the coil are usually by way of a relatively long coaxial cable, connected directly to the r.f. source, and a resonant matching network, connected between the cable and reactive impedance element. The matching network includes a pair of variable reactances, adjusted to match the impedance of the source to the load it is driving.

The load seen by the source is subject to substantial variations. The load has a relatively high impedance prior to ignition of the gas into a plasma state. In response to the plasma being ignited, the load impedance drops substantially due to the presence of the charge carriers, i.e., electrons and ions, in the excited plasma. The ignited plasma impedance also changes substantially due to variations in the plasma flux, i.e. the product of the plasma density and the plasma charge particle velocity. Hence, matching the source to the load to provide efficient transfer of power from the source to the load is somewhat difficult.

In the past, the same technique which is used to maintain a matched condition between the source and load during normal operation of the ignited plasma has been used to control the variable reactances of the matching network at the time the gas is ignited into a plasma. This technique involves simultaneously varying both variable reactances to achieve a matched condition between the impedance seen looking into the output terminals of the source and the impedance seen by the source looking from its output terminals into the cable driving the matching network. In this technique, the values of the two reactances are simultaneously varied until (1) there is approximately a zero phase difference between the voltage and current supplied by the source to the cable and (2) the real impedance component seen looking into the source output terminals approximately equals the real impedance seen looking from the source output terminals into the cable.

It has been found that, in certain circumstances, this prior art approach is completely unsatisfactory because the gas is never ignited into a plasma. The values of the reactances are simultaneously varied in such a way that the power delivered to the reactive impedance element which produces the electric or electromagnetic field is never adequate for plasma ignition. In other situations, ignition is finally reached after a considerable length of time is spent changing the values of the reactances. The values of the reactances are simultaneously varied in a haphazard way, with no determination made as to what is the optimum direction to change the values of the reactances from initial values thereof.

It has also been suggested that the value of only one of the reactances of the matching network be changed until plasma ignition is obtained; see the co-pending, commonly assigned application Ser. No. 08/580,706, now U.S. Pat. No. 5,793,162, issued Aug. 11, 1998 of Barnes et al, entitled APPARATUS FOR CONTROLLING MATCHING NETWORK OF A VACUUM PLASMA PROCESSOR AND MEMORY FOR SAME, filed Dec. 29, 1995. It has been found, however, that this approach is not always reliable. Under certain conditions, varying only one of the reactances does not enable sufficient power to be coupled from the source to the chamber to ignite the gas into the plasma.

It is, accordingly, an object of the present invention to provide a new and improved method of and apparatus for controlling the reactances of a matching network connected between an r.f. source and a vacuum plasma processing chamber to provide sufficient power to the chamber so a gas in the chamber is reliably ignited to a plasma.

Another object of the invention is to provide a new and improved method of and apparatus for controlling reactances of a matching network connected between an r.f. source and a plasma processing chamber in such a way that the values of the reactances are varied to provide rapid ignition of a gas in the chamber into a plasma.

Another object of the invention is to provide a new and improved method of and apparatus for varying the values of reactances of a matching network connected between an r.f. source and a vacuum plasma processing chamber so the values of the reactances are varied in the correct direction to maximize a function indicative of the power coupled from an r.f. source to the chamber.

SUMMARY OF THE INVENTION

In accordance with one aspect of the invention, a gas in a vacuum plasma processing chamber is ignited to a plasma by subjecting the gas to an r.f. field derived from an r.f. source having a frequency and power level sufficient to ignite the gas into the plasma and to maintain the plasma. The r.f. field is supplied to the gas by a reactive impedance element connected via a matching network to the r.f. source. The matching network includes first and second variable reactances that control loading of the source and tuning a load, including the reactive impedance element and the plasma, to the source. The value of only one of the reactances is varied until a local maximum of a function of power coupled between the source and the load is reached. The value of only the other reactance is varied until a local maximum of the function is reached. The two varying steps are then repeated as necessary.

According to one embodiment, the two varying steps are repeated until plasma ignition is detected. Then the values of the first and second reactances are varied until the source and a load connected to the source are approximately matched and the load connected to the source is tuned to the source.

According to a further embodiment the varying steps are repeated until the highest possible maximum of the function is reached. In one embodiment, the function is based on a ratio of power delivered to the load to power derived from the source. In another embodiment, the function is current flowing in a line connected between the source and the load, particularly between the matching network and the reactive impedance element. Use of these functions is advantageous over the prior art approach of responding to phase angle and real impedance component because with these functions only one variable is needed to provide an indication of the extent of a matched condition.

Plasma ignition is detected in one embodiment by determining that a function of r.f. power reflected back to the source is less than a threshold. In a second embodiment plasma ignition is detected by determining that impedance seen looking from output terminals of the source away from the source minus the impedance seen looking into the source output terminals is less than a predetermined value.

Another aspect of the invention is directed to a memory for use in a computer in combination with an apparatus for igniting a gas to a plasma in a vacuum plasma processing chamber. The gas in the chamber is coupled with a reactive impedance element for coupling an r.f. field to the gas. The r.f. field is derived from an r.f. source having a frequency and power level sufficient to ignite the gas into the plasma and to maintain the plasma. The reactive impedance element is connected to an r.f. source via a matching network including first and second variable reactances that control loading of the source and tuning a load, including the reactive impedance element and the plasma, to the source. The memory comprises a medium that stores signals to control the computer so the computer can derive signals to control the values of the first and second reactances so (1) the value of only one of the reactances is varied until a function of power coupled between the source and the load is locally maximized, (2) then the value of only the other reactance is varied until the function of power coupled between the source and the load is locally maximized. Operations (1) and (2) are repeated as necessary.

The above and still further objects, features and advantages of the present invention will become apparent upon consideration of the following detailed descriptions of several specific embodiments thereof, especially when taken in conjunction with the accompanying drawings.

DESCRIPTION OF THE PREFERRED EMBODIMENT

Figure 1:
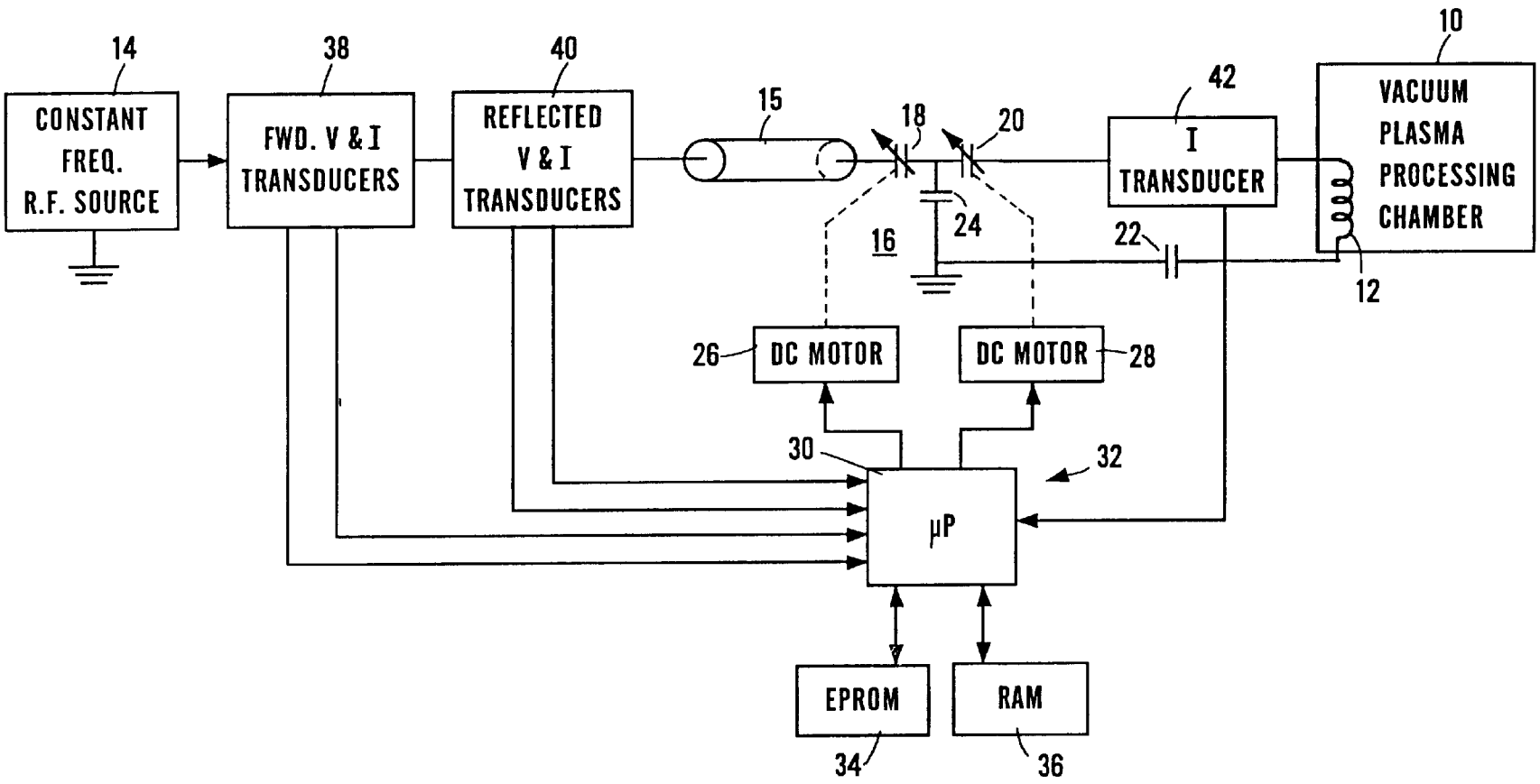
FIG. 1 is a block diagram of a preferred embodiment of the invention.

Reference is now made to FIG. 1 of the drawing, wherein conventional vacuum plasma processing chamber 10 is illustrated as including excitation coil 12, connected to constant frequency (typically 13.56 MHz) r.f. source 14 by way of resonant matching network 16. Coil 12 is a reactive impedance element for deriving an r.f. electromagnetic field that is coupled from outside of chamber 10 through a dielectric window (not shown) of the chamber to the chamber interior. Vacuum plasma processing chamber 10 is supplied with a gas from a suitable source (not shown). The gas is excited to and maintained in a plasma state (i.e., as a plasma discharge) by the r.f. electromagnetic field derived from coil 12. A workpiece (not shown), typically a glass, semiconductor or metal substrate, located in chamber 10 is processed by charge particles, i.e. electrons and ions, and neutral particles in the plasma so the workpiece is etched and/or material is deposited thereon. The plasma discharge and coil 12 form a load for source 14 and resonant matching network 16. Source 14 is connected to network 16 by cable 15, usually having a relatively long length, e.g. 13 feet. Cable 15 has a characteristic impedance at the frequency of source 14 equal to the output impedance of the source.

The plasma discharge in chamber 10 is subject to transient and nonlinear variations, which are reflected by matching network 16 and cable 15 to output terminals of r.f. source 14. Impedances of matching network 16 are controlled to minimize the power reflected back to the output terminals of source 14 despite these variations.

In a preferred embodiment, matching network 16 is configured as a "T, " having two series arms, respectively including variable reactances in the form of series capacitors 18 and 20. The arm including capacitor 20 is in series with coil 12, in turn connected in series with fixed grounded capacitor 22. Matching network 16 also includes fixed shunt capacitor 24, connected between a common terminal for capacitors 18 and 20 and ground. Capacitor 18 primarily controls the magnitude of the resistive impedance component seen looking from the output terminals of source 14 into cable 15, while capacitor 20 primarily controls the magnitude of the reactive impedance seen looking from the output terminals of source 14 into cable 15. Frequently, capacitors 18 and 20 are respectively referred to in the art as the load and tune capacitors.

The values of capacitors 18 and 20 are usually varied so the output impedance of source 14, i.e. the impedance seen looking into the output terminals of source 14, usually 50 ohms resistive and zero ohms reactive ((50+j0)ohms), is matched to the impedance seen looking from the output terminals of the source into the input terminals of cable 15. The values of capacitors 18 and 22 are respectively varied by DC motors 26 and 28, supplied with DC control voltages by a digital to analog converter included in microprocessor 30 of microcomputer 32. Microcomputer 32 also includes EPROM 34 and RAM 36 that respectively store control program signals for the microprocessor and data signals that are manipulated by the microprocessor to control motors 26 and 28.

Microprocessor 30 includes an analog to digital converter responsive to signals from forward voltage and current transducers 38 and from reflected voltage and current transducers 40, as well as current transducer 42 that monitors the r.f. current flowing from matching network 16 to coil 12. Transducers 38 derive analog signals that are replicas of the r.f. voltage and current supplied by source 14 to cable 15. Transducers 40 derive analog signals that are replicas of the r.f. voltage and current reflected from cable 15 back to source 14. Each of transducers 38 and 40 includes a directional coupler, a current transformer for deriving the current replica and a capacitive voltage divider for deriving the voltage replica. Current transducer 42 includes a current transformer for deriving a signal that is a replica of the r.f. current flowing through coil 12. While transducer 42 is shown as being in a line between matching network 16 and coil 12, the current transducer could be connected in a line from coil 12 to ground.

Microprocessor 30 responds to the analog signals derived from transducers 38, 40 and 42 to derive digital signals indicative of (1) the magnitude and relative phase angle of the r.f. voltages and currents supplied by source 14 to cable 15 and reflected from the cable to the source and (2) the r.f. current magnitude flowing from network 16 to coil 12. These digital signals are stored in RAM 36 and are manipulated by microprocessor 30 under the control of program signals stored in EPROM 34 to derive further signals that are used to derive control signals for motors 26 and 28.

In accordance with the present invention, the values of capacitors 18 and 20 are varied by motors 26 and 28 in response to signals derived by microprocessor 30 to supply sufficient power to coil 12 to ignite the gas in chamber 10 to a plasma. The values of capacitors 18 and 20 are varied in a direction to maximize a function of power coupled from source 14 to coil 12. The function can be any of: (1) the ratio of delivered r.f. power to forward r.f. power, (2) percent delivered r.f. power, or (3) r.f. current supplied by matching network 16 to coil 12. When these functions are maximized, there is a substantial impedance match, at the frequency of source 14, between the source and the load it is driving, i.e., the impedance, at the source frequency, seen looking into the output terminals of source 14 is approximately equal to the impedance seen looking from the source into cable 15.

Microprocessor 30 determines forward r.f. power, i.e., the r.f. power supplied by source 14 to cable 15, and delivered power, i.e., the power actually supplied to coil 12 by matching network 16, in response to the output signals of transducers 38 and 40. To this end, microprocessor 30 determines r.f. forward power ($P_f$) by multiplying signals representing the r.f. voltage and current outputs of transducer 38 in accordance with $$P_f = V_o I_o \cos\theta_o$$

where:

$V_o$ is the magnitude of the r.f. output voltage of source 14, $I_o$ is the magnitude of the r.f. output current of source 14, and $\theta_o$ is the phase angle between the voltage and current derived from source 14.

To determine delivered r.f. power, microprocessor 30 determines reflected r.f. power. Microprocessor 30 determines reflected r.f. power ($P_r$) in response to the r.f. voltage and current outputs of transducer 40 in accordance with $$P_r = V_r I_r \cos\theta_r$$

where:

$V_r$ is the magnitude of the r.f. voltage reflected from cable 15 to source 14, $I_r$ is the magnitude of the r.f. current reflected from cable 15 toward source 14, and $\theta_r$ is the phase angle between the reflected voltage and current.

Microprocessor 30 determines delivered r.f. power ($P_d$) as ($P_f$–$P_r$) Percent delivered r.f. power (% $P_d$) is similar to the ratio of r.f. delivered power to r.f. forward power but is calculated by microprocessor 30 as $$\frac{P_f - P_r}{P_f} \times 100.$$

When there is a match, there is no r.f. reflected power, so (a) $P_d = P_f$, (b) the ratio of delivered r.f. power to forward power ($P_d/P_f$) is 1, and (c) % Pd=100.

Microprocessor 30 determines the r.f. current ($I_c$) supplied by matching network 16 to coil 12 exclusively in response to the output signal of current transducer 42. Actual experimentation reveals that maximizing r.f. current $I_c$ enables the values of capacitors 18 and 20 to be varied in the correct direction to achieve ignition of the gas to a plasma with greater signal sensitivity than maximizing ($P_d/P_r$) or % $P_d$. It has been found that maximizing Ic provides a better measurement of the presence of ignition over broader range of values for capacitors 18 and 20 than is attained by maximizing ($P_d/P_r$) or % $P_d$.

Microprocessor 30 also responds to the outputs of transducers 38 to determine the complex r.f. impedance seen by looking from the output terminals of source 14 into cable 15. Microprocessor 30 calculates the complex impedance in the usual way, in response to the magnitudes of the r.f. voltage and current outputs of transducers 38 and the relative phase angle of the voltage and current derived from transducers 38.

Figure 2:
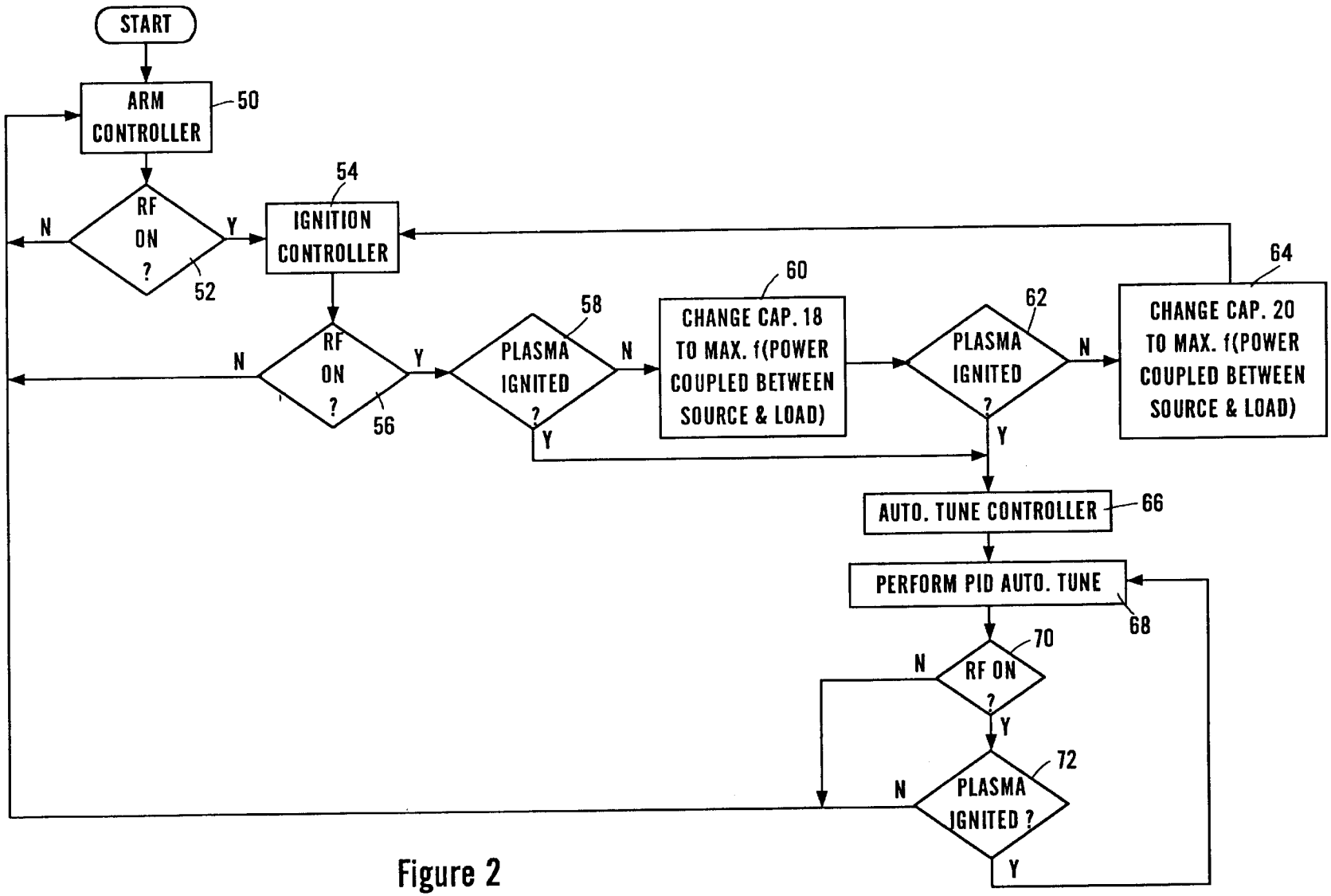
FIG. 2 is a flow diagram of a program for controlling the microprocessor of FIG. 1.

The operations performed by microprocessor 30 in response to the program stored in EPROM 34 to ignite the gas in chamber 10 into a plasma are illustrated in FIG. 2. The program is entered in controller armed operation 50. Then, during operation 52, microprocessor 30 determines whether r.f. source 14 is energized. During operation 52 microprocessor 30 determines if the power ($P_f$) derived from source 14 exceeds a predetermined level, such as 10 watts; the predetermined value is stored in a memory location of RAM 36 or EPROM 34. In response to operation 52 indicating that r.f. power source 14 is not energized, microprocessor 30 returns to controlled armed operation 50. Microprocessor 30 cycles back and forth between operations 50 and 52 until, during operation 52, the microprocessor detects that r.f. source 14 is on.

In response to operation 52 signalling that r.f. source 14 is on, the program causes microprocessor 30 to enter controller ignition operation 54. In the first operation after controller ignition operation 54, microprocessor 30 determines, during operation 56, whether r.f. source 14 is on; operation 56 is performed the same way as operation 52. In response to operation 56 indicating r.f. source 14 is not on, the program causes microprocessor 30 to return to controller armed operation 50. If, however, operation 56 indicates r.f. source 14 is on, microprocessor 30 advances to operation 58, during which the microprocessor determines whether the gas in chamber 10 has been activated to an r.f. plasma state.

The determination of operation 58 can be made by supplying to microprocessor 30 an output signal of an optical detector (not shown) that responds to the condition of the plasma in chamber 10. However, such an approach requires an additional detector for supplying an additional signal to microprocessor 30.

In accordance with one aspect of the invention, the need for such an optical detector is obviated and microprocessor 30 determines whether the gas is ignited to a plasma by responding to signals from transducers 38 and 40. In one preferred embodiment, microprocessor 30 determines whether the gas is ignited to a plasma by detecting whether the calculated r.f. reflected power, $P_r$, is less than a threshold value stored in EPROM 34 or RAM 36. In response to microprocessor 30 determining that the calculated r.f. reflected power is less than the threshold, the microprocessor signals the plasma is ignited; a typical threshold for a plasma in the 180–800 watt range is 40 watts. In other words, if microprocessor 30 detects that the reflected power is less than 40 watts, the microprocessor signals that the plasma is in an ignited state.

According to another preferred embodiment, microprocessor 30 determines whether the real impedance component seen by looking from the output terminals of source 14 into cable 15 is approximately equal to the impedance seen looking into the output terminals of source 14, usually (50+j0) ohms. Microprocessor 30 subtracts the real impedance component seen looking from the output terminals of source 14 from the known output impedance of source 14, as seen by looking into the output terminals of the source. In response to the absolute value of the resulting difference being less than a threshold, microprocessor 30 determines that the plasma is ignited. For a typical (50+j0) ohm output impedance of source 14, the threshold is usually about 10 ohms.

In accordance with a further embodiment, the plasma is detected as being ignited by detecting the complex impedance seen by looking from the output terminals of source 14 into cable 15. The magnitude of the complex impedance seen looking from the output terminals of source 14 into cable 15 is subtracted from the impedance of the source, as seen by looking into the source output terminals. In this situation, the threshold of the absolute value of the difference is set to zero.

In response to operation 58 indicating that the plasma is not ignited, the program advances to operation 60. During operation 60 only one of variable capacitors 18 or 20 of matching network 16 is changed. It is to be understood that either one of capacitors 18 or 20 can be initially changed; for the described embodiment, load capacitor 18 is initially changed.

When microprocessor 30 initially enters the program of FIG. 2 it supplies signals to DC motors to establish initial condition values for capacitors 18 and 20. The initial condition values of capacitors 18 and 20 are determined by values stored in EPROM 34 or RAM 36 and are empirically determined to be the values of these capacitors at which ignition has most frequently occurred, on an historical basis. The directions in which the values of capacitors 18 and 20 are initially varied is also determined by previously gathered data which indicate, on an historical basis, the direction of change of each capacitor value toward the maximum local value of the power coupled between source 14 and coil 12. These directions are also stored in EPROM 34 or RAM 36.

Microprocessor 30 then is driven by the program in EPROM 34 to operation 60. During operation 60, microprocessor 30 varies the value of capacitor 18 from the initial value in the first direction until the value of % $P_d$, $P_r$ or $I_c$ (whichever one is used as the function indicative of impedance match) goes through a maximum value. When microprocessor 30 determines that the function has gone through a maximum value, it changes the value of capacitor 18 in the second direction, opposite from the first direction, until the just previously determined maximum value of the function is again reached. Operation 60 is then terminated and the program advances microprocessor 30 to operation 62.

If the initial change, in the first direction, in the value of capacitor 18 during operation 60 does not result in an increase of the function relating power coupled from source 14 to coil 12, microprocessor 30 changes the value of capacitor 18 in the second direction, opposite from the first direction. Thus, for example, if microprocessor 30 initially increases the value of capacitor 18 from its initial value and no increase in the function relating power coupled from source 14 to coil 12 is detected during operation 60, the microprocessor drives the value of capacitor 18 in the opposite direction, i.e., the microprocessor decreases the value of capacitor 18. The value of capacitor 18 is decreased until the value of the function relating power coupled from source 14 to coil 12 goes through a maximum. After the maximum value of the function has been detected, the value of capacitor 18 is again increased until the maximum value of the function is again reached. When the maximum value of the function is reached, no further changes in the value of capacitor 18 occur and the value of the capacitor is maintained at the value which resulted in a "local" maximum value of the function.

After microprocessor 30 has changed capacitor 18 so the power function is again maximized during operation 60, the microprocessor again determines, during operation 62, whether the gas in chamber 10 has been ignited to a plasma. In response to operation 62 indicating that the gas has not been ignited to a plasma, the program causes microprocessor 30 to proceed to operation 64. During operation 64, the value of capacitor 20 is again varied. The value of capacitor 20 is varied in a direction opposite to the direction that the value of capacitor 20 was last varied during the previous operating cycle which resulted in maximizing the function relating power coupled from source 14 to coil 12.

After operation 64 has been completed, the program causes microprocessor 30 to return to controller ignition step 54, thence to r.f. detection step 56. In response to the microprocessor determining, during r.f. detection step 56, that r.f. power is being supplied by source 14 to cable 15, the program advances to plasma ignition detection step 58. In response to microprocessor 30 determining, during operation 58, that the plasma is still not ignited, the microprocessor program advances to operation 60, to change the value of capacitor 18 again. During the second and subsequent operating cycles microprocessor 30 changes the value of capacitor 18 in the opposite direction from the direction capacitor 18 was last varied during the previous operating cycle which resulted in maximizing the function of power coupled from source 14 to coil 12.

Operation continues in this manner repeatedly until ignition is detected during operation 58 or 62, unless EPROM 34 stores a zero value for the threshold of the absolute value of the impedance seen by looking from the output terminals of source 14 into cable 15 minus the impedance of the source looking into the source output terminals. Because the zero threshold can only be achieved when a match exists, operations 58 and 62 incorrectly signal that ignition has not occurred even though ignition has occurred. Microprocessor 30 continues to vary the values of capacitors 18 and 20 after ignition has been reached, until a match exists. In the other embodiments, wherein the threshold has a non-zero value or microprocessor 30 detects ignition by other described procedures, the microprocessor exits the controller ignition subroutine 54 and enters controller auto-tune subroutine 66 when either of operations 58 or 62 indicates ignition has been detected.

After subroutine 66 has been entered, the program causes microprocessor 30 to advance to operation 68. During operation 68 microprocessor 30 performs a proportional, integral, differential (PID) control algorithm to simultaneously change the values of capacitors 18 and 20. The PID control of operation 68 is performed in the usual manner, as well known to those of skill in the art. During operation 68, microprocessor 30 changes the values of capacitors 18 and 20 so there is a zero phase angle between the voltage and current supplied by source 14 to cable 15 and the magnitude of the impedance seen by looking from the output terminals of the source into cable 15 equals the impedance seen looking into the output terminals of the source. In other words, during operation 68 the values of capacitors 18 and 20 are varied so there is an impedance match between the impedance seen looking into the output terminals of source 14 and the impedance seen looking from the output terminals of source 14 into cable 15. It is to be understood that other approaches can be used for controlling capacitors 18 and 20 to achieve an impedance match between source 14 and the load it drives.

Operation 68 continues until r.f. source 14 is deenergized or the plasma in chamber 10 is extinguished. To this end, while operation 68 is being performed, operations 70 and 72 are periodically executed. During operation 70 microprocessor 30 determines whether r.f. source 14 is energized. If operation 70 indicates source 14 is on, the program executed in microprocessor 30 advances to operation 72 when the microprocessor determines if the plasma in chamber 10 is ignited. If operation 72 indicates the plasma is ignited the program returns to PID autotune step 68. If either operation 70 or 72 indicates the r.f. source is off or the plasma is not ignited the program returns to arm controller operation 50 and the sequence is repeated.

While there have been described and illustrated several specific embodiments of the invention, it will be clear that variations in the details of the embodiments specifically illustrated and described may be made without departing from the true spirit and scope of the invention as defined in the appended claims. While the matching network 16 is specifically illustrated as a T, it is to be understood that the matching network can be configured as an "L" including a shunt variable load capacitor and a series variable tune capacitor connected to the reactive impedance element that excites the plasma. Such L networks are frequently used with capacitive type impedance plasma excitation reactances and include a fixed inductor connected in series with the excitation reactance. As is known in the art, an "L" type matching network is usually adjusted at a matched condition so it delivers maximum voltage to its load at the frequency of the r.f. source. In contrast, a "T" type matching network is usually adjusted at a matched condition so it operates along the "skirt" of the network, i.e., the T networks do not usually deliver maximum voltage at a matched condition.

What is claimed:

1. A method of igniting a gas to a plasma in a vacuum plasma chamber for processing a workpiece including any of a metal substrate, semiconductor substrate or dielectric substrate, comprising (1) prior to ignition subjecting the gas to an r.f. field derived from an r.f. source having a frequency and power level sufficient to ignite the gas into the plasma and to maintain the plasma, the r.f. field being supplied to the gas by a reactive impedance element connected via a matching network to the r.f. source, the matching network including first and second variable reactances that respectively control loading of the source and tuning the source to a load including the reactive impedance element and the plasma for processing the workpiece, (2) then varying the value of only one of the reactances until a local maximum of a function of power coupled between the source and the load is reached, (3) then varying the value of only the other reactance until a local maximum of the function of power coupled between the source and the load is reached, and (4) then repeating steps (2) and (3) if the plasma is not ignited, the plasma when ignited causing at least one of (a) material to be etched from the workpiece and (b) material to be deposited on the workpiece.

2. The method of claim 1 further including detecting plasma ignition and terminating steps (2), (3) and (4) when plasma ignition is detected.

3. The method of claim 1 wherein plasma ignition is detected by determining that an impedance seen looking from output terminals of the source away from the source minus an impedance seen looking into the source output terminals is less than a predetermined value.

4. The method of claim 1 further including detecting plasma ignition and terminating steps (2), (3) and (4) when plasma ignition is detected, then, after plasma ignition is detected, controlling the values of the first and second reactances so the source and a load connected to the source are approximately matched.

5. The method of claim 1 wherein the function of power coupled between the source and the load is based on a ratio of power delivered to the load to power derived from the source.

6. The method of claim 5 wherein the function of power coupled between the source and the load is percent delivered power.

7. The method of claim 1 wherein the function of power coupled between the source and the load is exclusively amplitude of r.f. current flowing in a line connected between the source and the load.

8. The method of claim 7 wherein the line is connected to the reactive impedance element.

9. The method of claim 1 wherein plasma ignition is detected by determining that a function of r.f. power reflected back to the source is less than a threshold.

10. A memory usable with a computer, the computer being in combination with an apparatus for igniting a gas to a plasma in a vacuum plasma chamber for processing a workpiece including any of a metal substrate, semiconductor substrate or dielectric substrate, the gas in the chamber being coupled with a reactive impedance element for coupling an r.f. field to the gas, the r.f. field being derived from a source having a frequency and power level sufficient to ignite the gas into the plasma and to maintain the plasma, the reactive impedance element being connected via a matching network to an r.f. source that can generate the r.f. field, the matching network including first and second variable reactances for respectively controlling loading of the source and tuning a load including the reactive impedance element and the plasma processing the workpiece to the source, the memory comprising a structure that stores signals to control the computer so the computer can derive signals to control the values of the first and second reactances prior to plasma ignition so (1) the value of the only one of the reactances is varied until a function of power coupled between the source and the load is locally maximized, (2) then the value of only the other reactance is varied until the function of power coupled between the source and the load is locally maximized, and (3) operations of steps (1) and (2) are repeated if the plasma is not ignited.

11. Apparatus for igniting a gas to a plasma in a vacuum plasma chamber for processing a workpiece including any of a metal substrate, semiconductor substrate or dielectric substrate, comprising a reactive impedance element, the reactive impedance element being positioned for electrical coupling with the gas in the chamber, an r.f. electric source, a matching network connected between the source and the reactive impedance, the matching network including first and second variable reactances for respectively controlling loading of the source and tuning the source with a load including the reactive impedance element and the plasma processing the workpiece, the r.f. source having a frequency and power level for causing the reactive impedance element to supply an electromagnetic field to the gas to ignite the gas to the plasma, the plasma when ignited causing at least one of (a) material to be etched from the workpiece and (b) material to be deposited on the workpiece, and a controller for controlling the values of the first and second variable reactances, the controller being responsive to a function of power coupled between the source and load, the controller being arranged so that prior to ignition, the controller: (1) varies the value of only one of the reactances until a function of power coupled between the source and the load has a local maximum value, (2) then varies the value of only the other reactance until the function of power coupled between the source and the load has a local maximum value, (3) detects whether or not the gas has been ignited to a plasma, and (4) repeats operations (1), (2) and (3) in response to operation (3) detecting that the plasma has not been ignited.

12. The apparatus of claim 11 wherein the controller is arranged to change, after plasma ignition is detected, the values of the first and second reactances so the source and a load connected to the source are matched.

13. The apparatus of claim 11 wherein the function of power coupled between the source and the load is exclusively the amplitude of r.f. current flowing in a line connected between the source and the load.

14. The apparatus of claim 13 wherein the controller is arranged to change, after plasma ignition is detected, the values of the first and second reactances so the source and a load connected to the source are matched.

15. The apparatus of claim 11 wherein the function is based on a ratio of power delivered to the load to power derived from the source.

16. The apparatus of claim 15 wherein the controller is arranged to change the values of the first and second reactances after plasma ignition is detected, the values of the first and second reactances being changed after plasma ignition has been detected so the source and a load connected to the source are matched.

17. The apparatus of claim 15 wherein the function of power coupled between the source and the load is percent delivered power.

18. The apparatus of claim 11 wherein the controller detects whether or not the plasma has been ignited in response to the magnitude of an electric parameter responsive to r.f. power reflected from the load to the source.

19. The apparatus of claim 18 wherein the parameter is such that the plasma is signalled as having been ignited in response to a real component of impedance seen looking from the source to the matching network having a predetermined value relative to the real component of impedance seen looking into output terminals of the source.

20. The apparatus of claim 18 wherein the parameter is such that the plasma is signalled as having been ignited in response to a complex impedance seen looking into the matching network from the source having at least a predetermined magnitude.

21. The apparatus of claim 18 wherein the parameter is such that the plasma is signalled as having been ignited in response to the r.f. reflected power being less than a threshold.

22. Apparatus for igniting a gas to a plasma in a vacuum plasma chamber for processing a workpiece including any of a metal substrate, semiconductor substrate or dielectric substrate comprising a reactive impedance element, the reactive impedance element being positioned for electrical coupling with the gas in the chamber, an r.f. electric source, a matching network connected between the source and the reactive impedance element, the matching network including first and second variable reactances for respectively controlling loading of the source and tuning the source to a load including the reactive impedance element and the plasma for processing the workpiece, the r.f. source having a frequency and power level for causing the reactive impedance element to supply an electromagnetic field to the gas to ignite the gas to the plasma, the plasma when ignited causing at least one of (a) material to be etched from the workpiece and (b) material to be deposited on the workpiece, an amplitude detector for r.f. current amplitude flowing between the r.f. source and the reactive impedance element, a plasma detector for detecting plasma ignition in the chamber, a controller responsive to the amplitude detector for controlling the values of the first and second variable reactances, the controller being arranged so that prior to plasma ignition the controller (1) varies the value of only one of the reactances until the r.f. current amplitude detected by the amplitude detector has a local maximum value, (2) then varies the value of only the other reactance until the r.f. current amplitude detected by the amplitude detector has a local maximum value, then repeats operations (1) and (2) until the plasma detector indicates ignition of the plasma in the chamber.

23. The apparatus of claim 22 wherein the plasma detector is responsive to an electrical parameter indicative of power reflected from the load in the plasma chamber.

24. Apparatus for igniting a gas to a plasma in a vacuum plasma chamber for processing a workpiece including any of a metal substrate, semiconductor substrate or dielectric substrate comprising a reactive impedance element, the reactive impedance element being positioned for electrical coupling with the gas in the chamber, an r.f. electric source, a matching network connected between the source and the reactive impedance element, the matching network including first and second variable reactances for respectively controlling loading of the source and tuning the source to a load including the reactive impedance element and the plasma for processing the workpiece, the r.f. source having a frequency and power level for causing the reactive impedance element to supply an electromagnetic field to the gas to ignite the gas to the plasma, the plasma when ignited causing at least one of (a) material to be etched from the workpiece and (b) material to be deposited on the workpiece, first detectors for detecting the amplitude of r.f. forward current and r.f. forward voltage coupled by the source to the matching network, and second detectors for detecting the amplitude of r.f. reflected current and r.f. reflected voltage coupled from the matching network to the source, a plasma detector for detecting plasma ignition in the chamber, a controller responsive to the first and second detectors for controlling the values of the first and second variable reactances, the controller being arranged so that prior to plasma detector detecting plasma ignition the controller (1) varies the value of only one of the reactances until a function of reflected and forward power has a local maximum value, (2) then varies the value of only the other reactance until a function of reflected and forward power has a local maximum value, then repeats operations (1) and (2) until the plasma detector indicates ignition of the plasma in the chamber.

25. The apparatus of claim 24, wherein the plasma detector responds to the second detectors, the plasma detector signalling that the plasma is ignited in response to a combined signal derived from output signals of the second detectors having a value commensurate with power reflected from the load to the source indicating the power reflected from the load to the source is less than a predetermined value.

26. The apparatus of claim 24, wherein the plasma detector responds to the second detectors, the plasma detector signalling that the plasma is ignited in response to a combined signal derived from output signals of the second detectors having a value commensurate with an impedance seen looking from the source toward the matching network indicating the impedance seen looking from the source toward the matching network has a real component in excess of a predetermined value.

27. A method of detecting whether or not gaseous ions in a vacuum plasma processing chamber that is processing a workpiece including any of a metal substrate, semiconductor substrate or dielectric substrate have been excited to an r.f plasma, the gaseous ions in the chamber being responsive to an r.f. field derived by a reactive impedance element responsive to r.f. electric energy derived an r.f. source and coupled to the reactive impedance element via a matching network including a pair of reactances, the method comprising detecting the value of an electric parameter determined by the amount of power reflected from the reactive impedance plasma excitation element back toward the source, comparing the detected value of the parameter with a threshold value of said parameter, signalling that the gaseous ions are excited to the r.f. plasma in response to the comparing step indicating the detected value lies on a first side of the threshold value of said parameter, and signalling that the gaseous ions are not excited into the r.f. plasma in response to the comparing step indicating the detected value lies on a second side of the threshold value of said parameter.

28. The method of claim 27 wherein the electric parameter is the magnitude of complex impedance seen looking from the source toward the matching network, the gaseous ions being signalled as being excited to the plasma in response to the comparison indicating that the magnitude of complex impedance seen looking from the source toward the matching network exceeds a predetermined level, the gaseous ions being signalled as not being excited to the plasma in response to the comparison indicating that the magnitude of complex impedance seen looking from the source toward the matching network is less than the predetermined level.

29. The method of claim 27 wherein the electric parameter is power reflected from the reactive impedance plasma excitation element toward the source, the gaseous ions being signalled as being (excited into the r.f. plasma in response to the reflected power being below the threshold value of said parameter, the gaseous ions being signalled as not being excited into the r.f. plasma in response to the reflected power being above the threshold value of said parameter.

30. The method of claim 27 wherein the electric parameter is the real component of impedance seen looking from the source toward the matching network, and the threshold value of said parameter is the real value of impedance seen looking into the source, the gaseous ions being signalled as being excited into the plasma in response to the comparison indicating that the real component of impedance seen looking from the source into the matching network deviates from the real component of impedance seen looking from the matching network into the source by less than a predetermined value, the gaseous ions being signalled as not being excited to the plasma in response to the comparison indicating that the real component of impedance seen looking from the source into the matching network deviates from the real component of impedance seen looking from the matching network into the source by more than the predetermined value.

31. Apparatus for detecting whether or not gaseous ions that are not initially in a plasma state in a vacuum plasma chamber for processing a workpiece including any of a metal substrate, semiconductor substrate or dielectric substrate have been ignited into a plasma discharge by an r.f. source connected to a reactive impedance plasma excitation element of the chamber, comprising a matching network including first and second variable reactances, a controller for controlling the values of the first and second reactances to achieve a substantially matched condition between source output impedance and impedance seen by the source looking toward the matching network, the controller being arranged so that prior to plasma ignition the controller controls the first and second reactances to achieve ignition of the plasma, the plasma when ignited causing at least one of (a) material to be etched from the workpiece and (b) material to be deposited on the workpiece, and an ignition detector for deriving a signal indicating the presence and absence of ignition of the plasma in the chamber, the ignition detector being responsive to an electric parameter determined by the amount of power reflected from the reactive impedance plasma excitation element back toward the source.

32. The apparatus of claim 31 further including an r.f. current detector for detecting the amount of r.f. current flowing between the reactive impedance plasma excitation element and the source, the controller responding to the current detector to control the values of the first and second reactances by an amount commensurate with the value of r.f. current flowing between the reactive impedance plasma excitation element and the source.

33. The apparatus of claim 31 further including a reflected power detector for the amount of power reflected from the reactive impedance plasma excitation element toward the source, the controller responding to the reflected power detector to control the first and second reactances.

34. The apparatus of claim 33 wherein the electric parameter to which the ignition detector is responsive is power reflected from the reactive impedance plasma excitation element toward the source, the plasma detector signalling that ignition has occurred in response to the power reflected from the reactive impedance plasma excitation element toward the source being below a predetermined level.

35. The apparatus of claim 31 wherein the electric parameter to which the ignition detector is responsive is power reflected from the reactive impedance plasma excitation element toward the source, the plasma detector signalling that ignition has occurred in response to the power reflected from the reactive impedance plasma excitation element toward the source dropping below a predetermined level.

36. The apparatus of claim 31 wherein the plasma is signalled as being ignited in response to the real component of impedance seen looking from the source to the matching network having a predetermined value relative to the real component of impedance seen looking into output terminals of the source.

37. The apparatus of claim 31 wherein the plasma is signalled as being ignited in response to the magnitude of complex impedance seen look ng from the source toward the matching network exceeding a predetermined level.

* * * * *